US008121510B2

(12) United States Patent
Roppongi

(10) Patent No.: US 8,121,510 B2
(45) Date of Patent: Feb. 21, 2012

(54) PRINTER WITH DUPLEX CIRCULATION ROUTE SPEED CONTROL

(75) Inventor: Atsushi Roppongi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 426 days.

(21) Appl. No.: 12/458,498

(22) Filed: Jul. 14, 2009

(65) Prior Publication Data

US 2010/0014884 A1 Jan. 21, 2010

(30) Foreign Application Priority Data

Jul. 15, 2008 (JP) ..... P2008-184170

(51) Int. Cl.

| | |
|---|---|
| ***G03G 15/00*** | (2006.01) |
| ***B65H 29/00*** | (2006.01) |
| ***B65H 39/10*** | (2006.01) |
| ***B65H 5/34*** | (2006.01) |

(52) U.S. Cl. ..... 399/82; 399/364; 399/389; 399/396; 399/397; 399/401; 271/184; 271/185; 271/186; 271/291; 271/270

(58) Field of Classification Search ..... 399/82, 399/364, 397, 401

See application file for complete search history.

(56) References Cited

U.S. PATENT DOCUMENTS

| | | | | |
|---|---|---|---|---|
| 4,745,435 | A * | 5/1988 | Sakata et al. | 399/322 |
| 4,849,795 | A * | 7/1989 | Spehrley et al. | 399/394 |
| 5,337,135 | A * | 8/1994 | Malachowski et al. | 399/401 |
| 5,473,419 | A * | 12/1995 | Russel et al. | 399/130 |
| 5,629,762 | A * | 5/1997 | Mahoney et al. | 399/364 |
| 5,651,539 | A * | 7/1997 | Yoshiuchi et al. | 271/9.09 |
| 5,689,795 | A * | 11/1997 | Mastrandrea | 399/407 |
| 5,983,049 | A * | 11/1999 | Matsuya et al. | 399/68 |
| 6,259,886 | B1 * | 7/2001 | Ishii et al. | 399/388 |
| 7,237,772 | B2 * | 7/2007 | Kamamura | 271/9.01 |
| 7,559,549 | B2 * | 7/2009 | Clark et al. | 271/270 |
| 2006/0239733 | A1 * | 10/2006 | Choi et al. | 399/396 |
| 2007/0110464 | A1 * | 5/2007 | Nakayama et al. | 399/45 |
| 2009/0035040 | A1 * | 2/2009 | Arai et al. | 399/397 |
| 2010/0129094 | A1 * | 5/2010 | Maeda et al. | 399/38 |

FOREIGN PATENT DOCUMENTS

| | | | |
|---|---|---|---|
| JP | 2002221832 | A * | 8/2002 |
| JP | 2005-280897 | A | 10/2005 |

* cited by examiner

*Primary Examiner* — David Gray
*Assistant Examiner* — David Bolduc
(74) *Attorney, Agent, or Firm* — The Nath Law Group; Jerald L. Meyer

(57) ABSTRACT

For a sheet circulating transfer route that includes a sheet transfer portion of a printing mechanism provided with a transfer belt for transfer of a sheet as positioned thereto, a transfer section provided with drive rollers for transfer of a sheet as image-formed by an image former of the printing mechanism, and a sheet invert portion operable for inversion of the sheet as image-formed, there is a drive controller adapted, in conformity to a condition that a sheet to be positioned in the printing mechanism is equal in length to or longer than a path distance from the image former to the drive rollers, to set a transfer speed of the sheet as image-formed by the drive rollers up as an identical speed to a transfer speed of the sheet as positioned by the transfer belt, and in non-conformity to the condition, to set it up as a greater speed than the transfer speed by the transfer belt.

3 Claims, 12 Drawing Sheets

PRINTER WITH DUPLEX CIRCULATION ROUTE SPEED CONTROL

BACKGROUND OF THE INVENTION

1. Field of the Invention

The present invention relates to printers adapted for a sheet transfer control, and in particular to a printer adapted for a sheet transfer control with a sheet circulating transfer route including a sheet invert portion for inverting a sheet between front side and back side.

2. Description of Related Art

There has been known printers configured with a sheet circulating transfer route including a sheet transfer portion of a printing mechanism and a sheet invert portion. The printers are adapted for a sheet with a print made on one side thereof by the printing mechanism to be inverted at the sheet invert portion, to make a print on the opposite side by the same printing mechanism. A recent trend of demands for printers with increased printing speeds is directed to implement a high productivity of print material by a high speed printing not only simply in one-side printing but also in both-side printing.

The productivity of print material mainly depends on a transfer speed of sheet commensurate with a printing speed at a sheet transfer portion of a printing mechanism. The transfer speed has been ruling transfer speeds of sheets at other sections of a sheet circulating transfer route in the past. Japanese Patent Application Laid-open Publication No. 2005-280897 discloses a printing technique that both-side printing of sheets is alternately done to a front side of a sheet and a back side of another sheet and transfer speeds in a sheet circulating transfer route are controlled in accordance with an associated sheet size, independently from a transfer speed at a printing mechanism. This technique permits a sufficient inter-sheet spacing to be secured with an enhanced productivity of print material.

SUMMARY OF THE INVENTION

However, for some sheet sizes, the technique cannot control transfer speeds in the sheet circulating transfer route independently from the transfer speed at the printing mechanism.

For instance, a normal printing is typically done on a "sheet of standard size (referred herein to as "regular sheet)" fed from a tray employed in a printer. However, the printer may be used for a "sheet with a different size from the standard size (referred herein to as an "irregular sheet)", in particular, a "sheet longer than the regular sheet in a transfer direction (referred herein to as a "long sheet)". On the way of a printing such a long sheet by a printing mechanism, the leading edge may be engaged to a transfer drive member in a section of a sheet circulating transfer route with a different transfer speed than the printing mechanism. In this situation, the printing will go wrong.

The present invention has been made in view of such an issue and has an object of providing a printer adapted to control a transfer speed at a sheet transfer portion of a printing mechanism and a transfer speed at a section of a sheet circulating transfer route extending downstream the sheet transfer portion in consideration of a length of sheet in a sheet transfer direction.

To achieve the object, according to an aspect of the present invention, a printer comprises a printing mechanism comprising a sheet transfer portion configured with a first drive member for transfer of a sheet as positioned thereto, and an image former configured to form an image on the sheet as positioned to provide a sheet as image-formed, a sheet circulating transfer route including the sheet transfer portion of the printing mechanism, a transfer section having a second drive member for transfer of the sheet as image-formed configured in a position at a prescribed path distance from the image former of the printing mechanism, and a sheet invert portion configured to invert the sheet as image-formed, a printing condition determiner configured to determine a set of printing conditions including a first condition that a sheet to be positioned in the printing mechanism is equal in length to or longer than the prescribed path distance and a long sheet to be printed on both sides thereof, and a drive controller configured to control the first drive member to establish a first transfer speed of the sheet as positioned and the second drive member to establish a second transfer speed of the sheet as image-formed in accordance with the set of printing conditions determined by the printing condition determiner, the drive controller being adapted, in conformity to the first condition, to set the second transfer speed as identical to the first transfer speed, and in non-conformity to the first condition, to set the second transfer speed as greater than the first transfer speed.

DETAILED DESCRIPTION OF THE PREFERRED EMBODIMENT

There will be described the preferred embodiments of the present invention with reference to the accompanying drawings.

Figure 1:
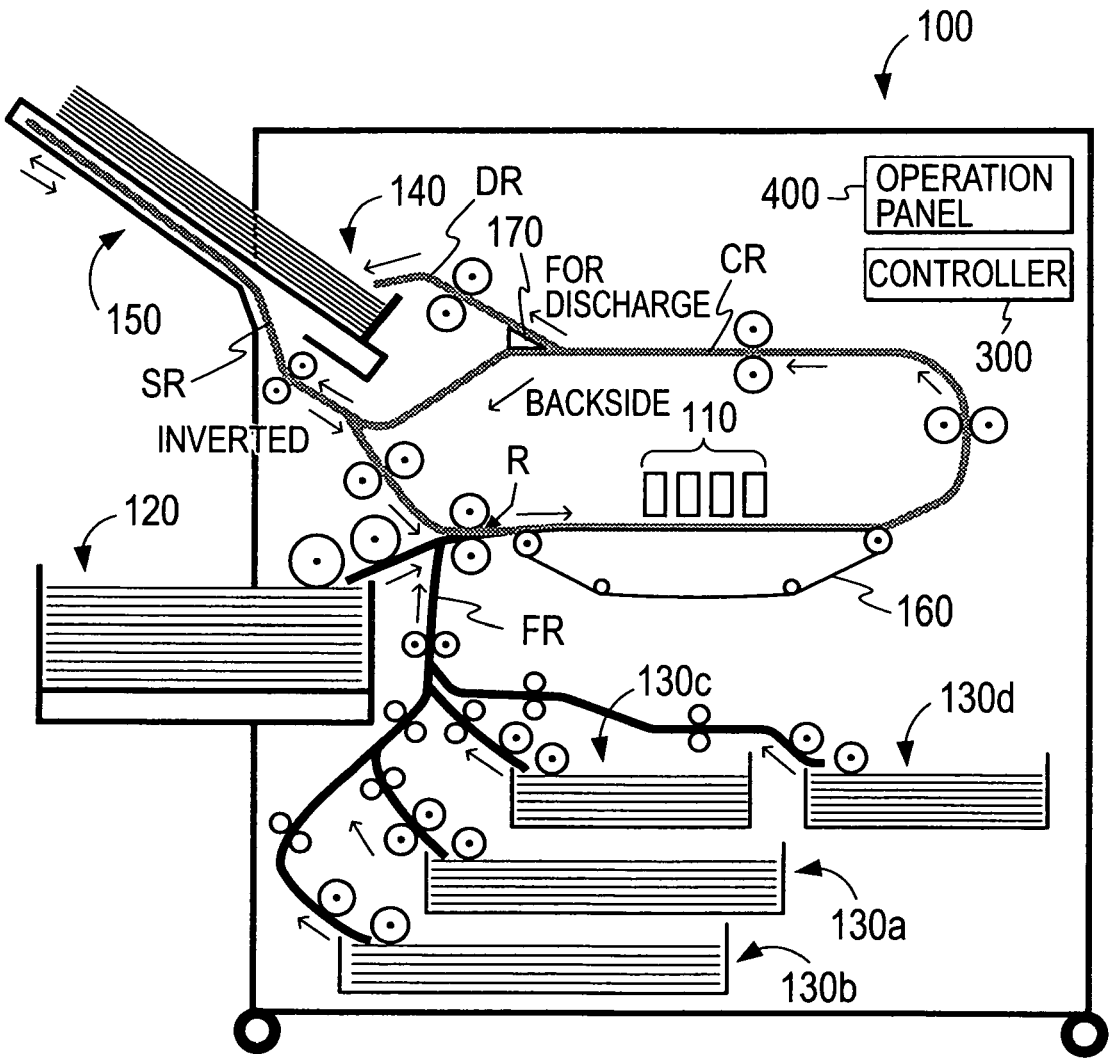
FIG. 1 is an illustration of configuration of a printer 100 according to an embodiment of the present invention.

FIG. 1 is an illustration of configuration of a printer 100 according to an embodiment of the present invention. As illustrated in the figure, the printer 100 has a sheet feeding mechanism including: a specified number of internal feed trays 130*a*, 130*b*, 130*c* and 130*d* (referred herein collectively to 130) incorporated in an equipment casing and adapted for feed of regular sheets; a side feed rack 120 exposed outside at a lateral side of the casing and adaptive for feed of irregular sheets; and a sheet discharging mechanism including a discharge port 140 for discharging any sheets as-printed. The printer 100 has a controller 300 composed of a substrate with a mounted CPU, memories, etc., and an operation panel 400 for interfacing user operations at a top side of the printer housing.

The printer 100 is a line color printer of an inkjet type for printing by lines. The line color printer has a printing mechanism including an array of print heads, each of which is formed with multiple nozzles in the direction perpendicular to a sheet transfer direction and operable to propel droplets of black or color ink for printing. It is noted that the present invention is applicable to printers such as of a serial inkjet system or a laser system. It is applicable to printers implementing individual printing processes including not only simply a printing based on transmitted data from a host computer but also a copy printing, facsimile printing, etc.

The printer 100 has a sheet transfer system that includes: a system of feed routes FR, as a part of the sheet feeding mechanism, for feeding a selective one of different types of regular sheets and irregular sheets; a sheet discharge route DR, as a part of the sheet discharging mechanism, for discharging any type of regular or irregular sheet; a normal transfer route PR (with a later-described sheet transfer portion of the printing mechanism inclusive) for transferring any sheet received from the system of feed routes FR to the sheet discharge route DR; and an inverting route SR, as a dropping switchback type sheet invert portion, branched from the normal transfer route PR, for inverting any sheet, received from the normal transfer route PR, between front side and back side, to re-feed to the nominal transfer route PR. The inverting route SR cooperates with the normal transfer route PR to constitute a looped sheet circulating transfer route CR.

A sheet is fed one by one from the side feed rack 120 or any feed tray 130 of the sheet feeding mechanism, and transferred along one route of the system of feed routes FR, by an associated drive mechanism such as rollers, to a register R constituting the sheet transfer portion (R, 160) of the printing mechanism (R, 160, 110). The register R is configured with a pair of register rollers 240 (see FIG. 2) for positioning a front edge of a fed sheet to a transfer belt 160 of the sheet transfer portion (R, 160), to avoid giving an oblique position to the sheet to be carried by the transfer belt 160. The fed sheet enters the register R, where it is once put in a pause, before being carried downstream in a sheet transfer direction at a controlled timing.

Past the register R, the sheet being carried by the transfer belt 160 proceeds along the normal transfer route PR, and comes under a head unit 110 that is an assembly of print heads constituting an image former (110) of the printing mechanism (R, 160, 110). The transfer belt 160 is looped, and has a top side thereof facing an ink droplet-propelling side of the head unit 110. On the top side of the transfer belt 160, the sheet is vacuum-contacted at the back side to be carried at a constant transfer speed-depending on a set of printing conditions described later on, while on the front-side of the sheet an image is formed (printed) by ink droplets propelled from the print heads, by the line or lines.

The sheet as printed is transferred by an associated drive mechanism such as rollers inside the casing. For one-side printing, the printed sheet is guided directly to the sheet discharge port 140, where it is discharged to stack, with a printed side down, on a discharge rack 150 provided as a sheet receiver at the sheet discharge port 140. The discharge rack 150 is set in the form of a tray protruding from the casing, with a certain thickness. The discharge rack 150 is inclined to a lateral wall of the casing, so the printed sheet once discharged from the sheet discharge port 140 is slid down along an inclination of the discharge rack 150, and trimmed to pile up on the discharge rack 150 in due course.

For both-side printing of any type of sheet, assuming "a front side" thereof as the side to be printed first and "a back side" thereof as the side to be printed next a sheet as printed on the front side is to be routed inside the casing without being guided to the sheet discharge port 140. This is implemented in the printer 100 by a route selecting mechanism 170 provided to select a sheet transfer route for back side printing. With this route selected by the route selecting mechanism 170, the sheet as printed on the front side is transferred to the inverting route SR. On the inverting route SR, the sheet is switched back in a dropping manner for inversion between front side and back side, and contacts at the (printed) front side with an upside of the sheet transfer route. This sheet is transferred along the route SR by an associated drive mechanism such as rollers, to re-feed to the register R, where it is put in a pause, before being carried downstream in the printing mechanism at a controlled timing, to have an image formed on the back side in a similar manner to the front side. The sheet now image-formed on both sides with the back side printed, is guided to the sheet discharge port 140, where it is discharged to stack on the discharge rack 150. It is noted that the sheet discharge port, which is single in this embodiment, may be substituted by a plurality of selective sheet discharge ports.

For the printer 100, an internal space of the discharge rack 150 is availed to implement a dropping switch back for both-side printing. The space in the discharge rack 150 is enclosed to keep a sheet or sheets from being taken from outside in the course of switchback. This prevents the sheet or sheets from being pulled out by a mistake of user in the course of switchback. The discharge rack 150, as an inherent member to the printer 100, affords to eliminate provision of an extra space for switchback in the casing of the printer 100. This permits the casing to be kept from being enlarged in size. The inverting route SR, separated from the sheet discharge port 140, allows for parallel operations between a sheet to be switched back and another sheet to be discharged.

In the printer 100, the register R is adapted to position in the front edge of an unprinted sheet fed thereto and a sheet printed up on the front side and re-fed thereto for both-side printing. The sheet circulating transfer route CR thus has, at a location just before the register R, a junction between the route CR for circulation of a sheet as printed on the front side and a feed route for transfer of an unprinted sheet. This junction is a reference to define the above-noted system of feed routes FR. That is, the feed route system FR is defined as a system of feed routes for interconnections from the respective feed trays 130 and the side feed rack 120 of the sheet feeding mechanism to the junction.

Figure 2:
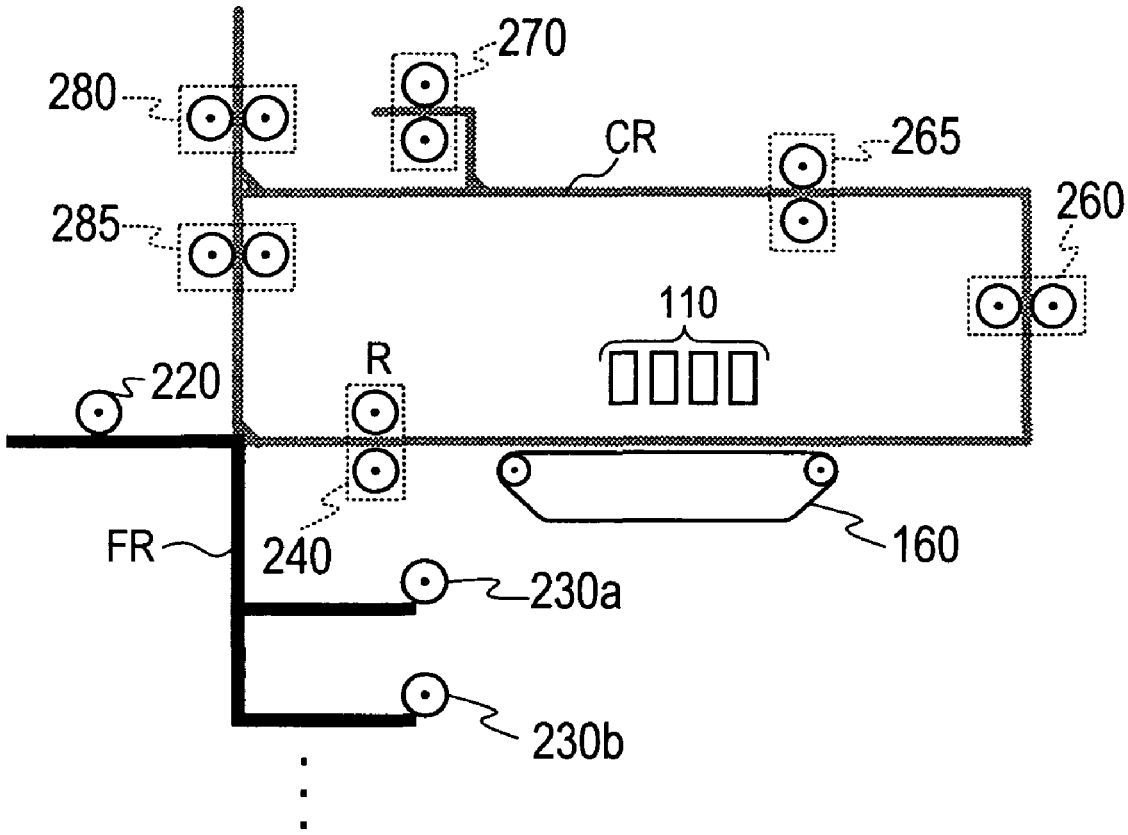
FIG. 2 is a schematic diagram of a sheet circulating transfer route CR and a system of feed routes FR of the printer 100.

FIG. 2 is a schematic diagram of the system of feed routes FR and the sheet circulating transfer route CR. For simplicity, main drive rollers are illustrated. The system of feed routes FR includes a transverse pair of side feed rollers 220 for feeding a sheet from the side feed rack 120, and a set of specified number of transverse pairs of tray rollers 230*a*, 230*b*, . . . (referred herein collectively to "230") for feeding a sheet from a selected one of feed trays 130. Those roller pairs are each operable to take up a sheet one by one from a stack of sheets in the side feed rack 120 or any feed tray 130, to transfer to the register R. Each roller pair is independently controllable.

The sheet circulating transfer route CR includes in order: a pair of front and rear register rollers 240; the transfer belt 160 facing the head unit 110; a pair or set of transverse pairs of front and rear first transfer rollers 260; a pair or set of transverse pairs of front and rear top rollers 265; a pair or set of transverse pairs of front and rear discharge rollers 270 for transferring a sheet as printed to the sheet discharge port 140; a pair or set of transverse pairs of front and rear switchback rollers 280 for pulling a sheet as printed up on the front side into the inverting route SR to invert in a dropping manner; and a pair or set of transverse pairs of front and rear re-feed rollers 285 for re-feeding an inverted sheet to the register R. Each roller pair or set is independently controllable. For instance, for a long sheet that has, in a course of printing thereon, a front end thereof reaching the top roller pair or set 265 (refer to FIG. 5C), whether one-side printing or both-side printing, the first transfer roller pair or set 260 is controllable to set a sheet transfer speed thereof up as consistent with a sheet transfer speed of the top roller pair or set 265, or to set free to employ as follower rollers, in accordance with an associated set of printing conditions.

According to the present embodiment, the printer 100 is operable not simply to feed a sheet after a previous fed sheet is printed and discharged, but also to feed a sheet before discharge of a previous fed sheet or previous fed sheets to be consecutively printed at specified intervals. That is, for a consecutive printing of sheets, the printer 100 is adapted for transfer of sheets on the sheet circulating transfer route CR.

The system of feed routes FR as well as the sheet circulating transfer route CR has unshown sheet sensors arranged in positions to detect presence or absence of sheet, feed errors, transfer jams, discharge errors, etc.

Figure 3:
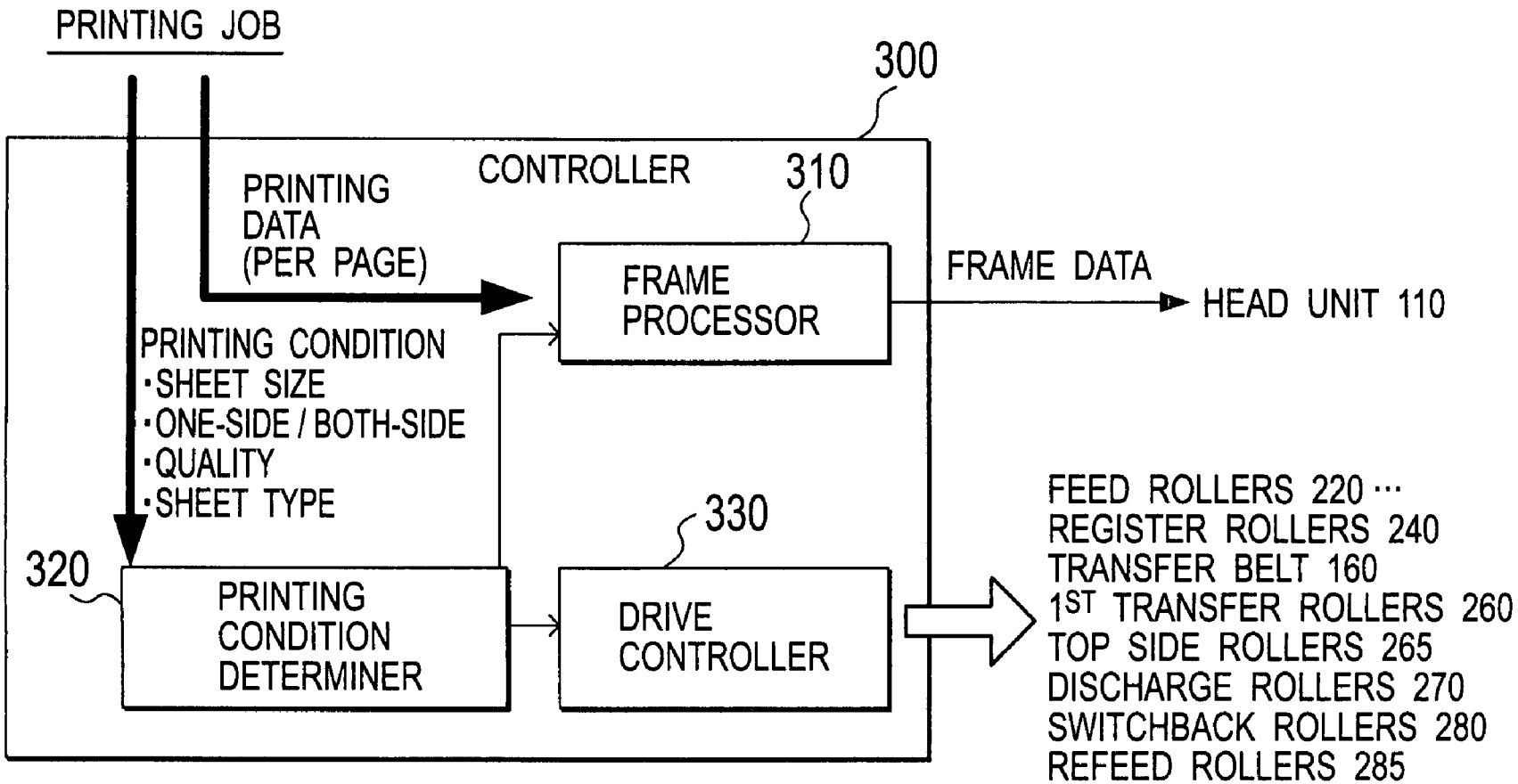
FIG. 3 is a block diagram of functional configuration of a controller 300 of the printer 100.

FIG. 3 is a block diagram of functional configuration of the controller 300 of the printer 100. The controller 300 sequentially receives one or more printing jobs transmitted from the PC connected to the printer 100, as well as one or more printing jobs interfaced through the operation panel 400. Each printing job includes a set of given printing conditions such as specifications for a color printing and a sheet to be fed, and a set of printing data such as pixel data for the color printing. In order for each printing job to be adjusted to a high-speed printing of the printer 100, the controller 300 is adapted to implement determination (identification and decision, see FIG. 10) of and on given printing conditions, to generate a new set of printing conditions including results of determination and necessary printing conditions. Based on this set of printing conditions, the controller 300 creates a series of sheet feed commands and a schedule of timings for sending those commands to drives (roller motors) for the system of feed routes FR, and a series of sheet transfer commands and a schedule of timings for sending these commands to drives (belt motors, roller motors) for the sheet circulating transfer route CR. Further, based on a combination the set of printing conditions and an associated set of printing data, the controller 300 creates a combination of a series of sequences of frames of image data and a series of sequences of print commands, and a schedule of timings for sending those sequences to a temporary storage portion (frame registers for heads) and a circuit drive portion (head drive circuits) of the printing mechanism.

The controller 300 has a printing condition determiner 320 adapted for determination of and on given printing conditions to provide a new set of printing conditions, a frame processor 310 adapted for processing given print data in accordance with the set of printing conditions to provide a sequence of frames of image data, and a drive controller 330 adapted on basis of the set of printing conditions for control of drives such as those of feed rollers 220 and 230, register rollers 240, transfer belt 160, and top rollers 265. Note here that a flame is defined as a unit making up image data. Although a sequence of frames makes up image data in the present embodiment, one frame may make up the image data in the present invention.

The printing condition determiner 320 is adapted on the basis of a set of given printing conditions for an associated printing job, to provide a new set of printing conditions adjusted to a high-speed printing of the printer 100. The set of given printing conditions includes, among others, a type and a size of a sheet to be positioned in the printing mechanism (specifically, to the sheet transfer portion, or more specifically, to the transfer belt 110) for the associated printing job, identification of the printing job to be one-side printing or both-side printing, a required quality of the printing, and the like. The new set of printing conditions includes, besides given printing conditions, conformity and non-conformity of a first condition (FIG. 10, step S104, Yes, No) that the sheet to be positioned is equal in length or longer than a later-described path distance S and a long sheet to be printed on both sides thereof, conformity or non-conformity of a second condition (FIG. 10, step S103, No) that the sheet to be positioned is a sheet to be printed on one side thereof, whether a regular sheet or an irregular sheet, conformity or nonconformity of a third condition (FIG. 10, step S104, No) that the first condition is non-conforming with a collateral condition that the sheet to be positioned is a sheet to be printed on both sides thereof, and a data on a fourth condition (FIG. 10, step S105, S107, or S110) that defines the number N of sheets to be simultaneously identified for control from feed to discharge of sheet.

The frame processor 310 responds to a set of printing conditions of an associated printing job, by generating a sequence of frames of image data on a sheet-side basis, to output to the head unit 110 of the printing mechanism. For a printing job of both-side printing, if a length Lp (refer to FIG. 5C) in a transfer direction of a sheet to be positioned in the printing mechanism is equal to or longer than a path distance S between the head unit 110 and paired upper rollers 265 (i.e. conformity of the $1^{st}$ condition), the frame processor 310 generates in order a sequence of frames of image data for a front side of the sheet, and a sequence of frames of image data for a back side of the sheet (refer to FIG. 9B). If the length Lp in the transfer direction of the sheet to be positioned is shorter (refer to FIG. 5B) than the path distance S between the head unit 110 and paired upper rollers 265 (i.e. conformity of the $3^{rd}$ condition), the frame processor 310 generates in order a sequence of frames of image data for a front side of the sheet, a sequence of frames of image data for a back side of a previous sheet of the sheet, and a sequence of frames of image data for a front side of a subsequent sheet of the sheet to be positioned (refer to FIG. 7B).

The drive controller 330 is adapted to set up a sheet transfer speed of the transfer belt 160 while printing in accordance with a set of printing conditions for an associated printing job. For a printing job of both-side printing, if the length Lp in transfer direction of a sheet is equal to or longer than the path distance S between the head unit 110 and paired upper rollers 265 (i.e. conformity of the $1^{st}$ condition), the drive controller 330 sets a sheet transfer speed of top rollers 265 up as an identical speed to the sheet transfer speed of the transfer belt 160 while printing (refer to FIG. 8B). If the length Lp in transfer direction of the sheet is shorter than the path distance S between the head unit 110 and paired upper rollers 265 (i.e. conformity of the $3^{rd}$ condition), the drive controller 330 sets a sheet transfer speed of top rollers 265 up as a greater speed than the sheet transfer speed of the transfer belt 160 while printing (refer to FIG. 6B). For a printing job of one-side printing (i.e. conformity of the $2^{nd}$ condition), the drive controller 330 sets a sheet transfer speed of top rollers 265 up as an identical speed to the sheet transfer speed of the transfer belt 160 while printing (refer to FIG. 6A and FIG. 8A), irrespective of the length Lp in transfer direction of sheet.

Figure 4:
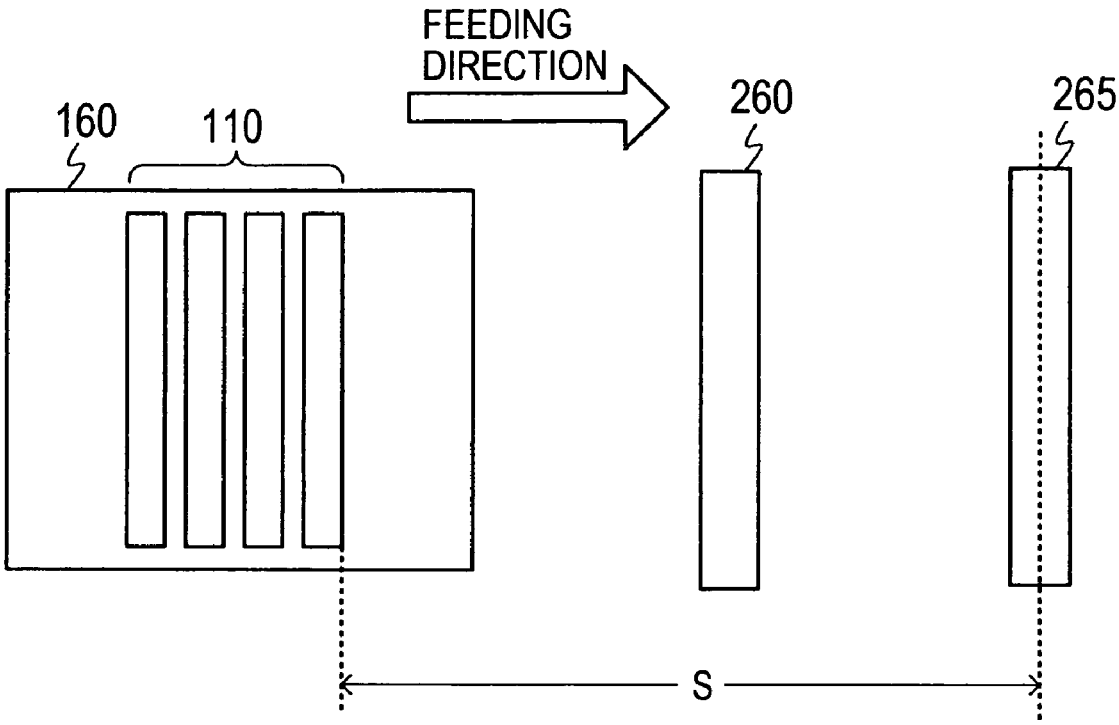
FIG. 4 is an illustration of a transfer belt 160, a head unit 110, a first transfer roller 260, and a top roller 265 arranged in the printer 100.

FIG. 4 is an illustration of the transfer belt 160, the head unit 110, a first transfer roller 260, and a top roller 265 arranged along the sheet circulating transfer route CR. An image is formed by the head unit 110 on an upside of a sheet being transferred by the transfer belt 160. The sheet as image-formed is to be transferred by paired first transfer rollers 260 and paired top rollers 265. FIG. 4 is an exploded view illustrating a path distance, and really the sheet circulating transfer route CR is curved, excepting principal parts of the printing mechanism and sheet invert portion. The path distance S is defined as a distance along the transfer route CR from a downstream end of the head unit 110 to a center position of upper rollers 265. This distance S is preset as an ex-factory specification of the printer 100, which is longer than a longitudinal dimension of a A4 size and shorter than a longitudinal dimension of a A3 size in this embodiment, while instead a fixing position of upper rollers 265 may well be optional or variable, so the path distance S can be set to a regular position of the user, permitting a registration through the operation panel 400.

Figure 5A:
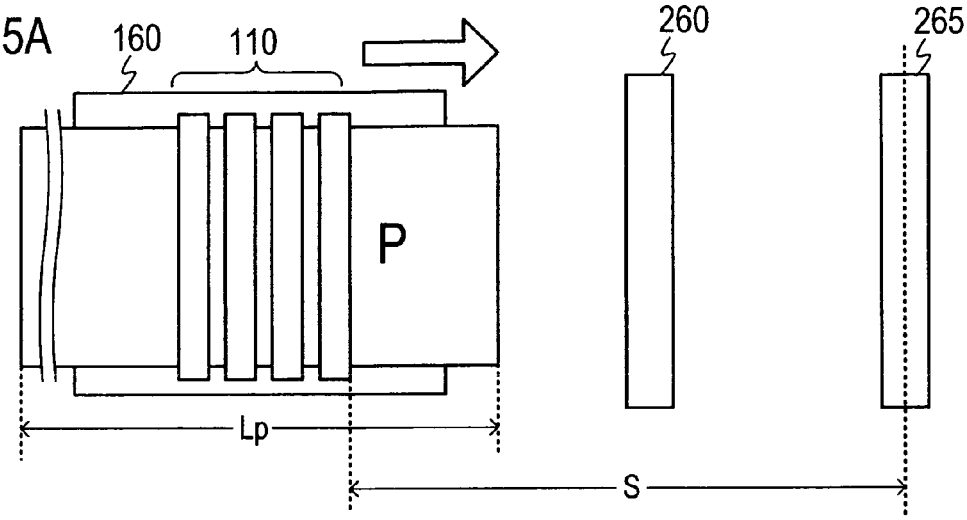
FIG. 5A is an illustration of a positional relationship between a path distance S from the head unit 100 to the top roller 265 and a sheet P with a length Lp, FIG. 5B an illustration of the positional relationship in printing to a regular sheet, and FIG. 5C an illustration of the positional relationship in printing to a long sheet.

A printing is now supposed on a sheet P with a length Lp in a transfer direction. FIG. 5A illustrates the printing. While forming an image, the head unit 110 continues propelling ink droplets, requiring a constant transfer speed of the sheet P. Letting Vg be the sheet transfer speed in a course of printing, the drive controller 330 is operated to drive the transfer belt 160 at the speed Vg while printing. The sheet transfer speed Vg depends on a subset of the above-noted set of printing conditions including a printing quality such as resolution, and a sheet type.

Paired first transfer rollers 260 are disposed nearer to the transfer belt 160 than paired top rollers 160. On the way of image formation by the head unit 110, first transfer rollers 260 may cooperate with the transfer belt 160 for transfer of a sheet P, and the drive controller 330 may drive the first transfer rollers 260 at the same transfer speed Vg as the transfer belt 160.

On the other hand, paired top rollers 160 are disposed at a path distance S from the head unit 110.

Figure 5B:
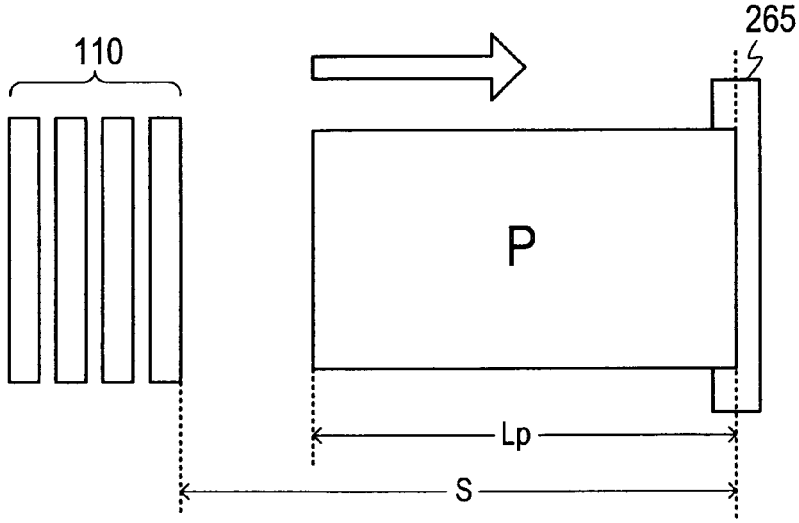

For use of a regular sheet P with a shorter length Lp in transfer direction than the path distance S, as illustrated in FIG. 5B, the head unit 110 completes formation of image before a leading edge of the sheet P reaches a position of top rollers 265. Paired top rollers 265 can thus have a sheet transfer speed Vr set independently of the above-noted sheet transfer speed Vg while printing. However, the transfer speed Vr of sheet P by top rollers 265 should be consistent with a sheet transfer speed of first transfer rollers 260. To avoid differences in between, first transfer rollers 260 may be each provided with a clutch mechanism.

Figure 5C:
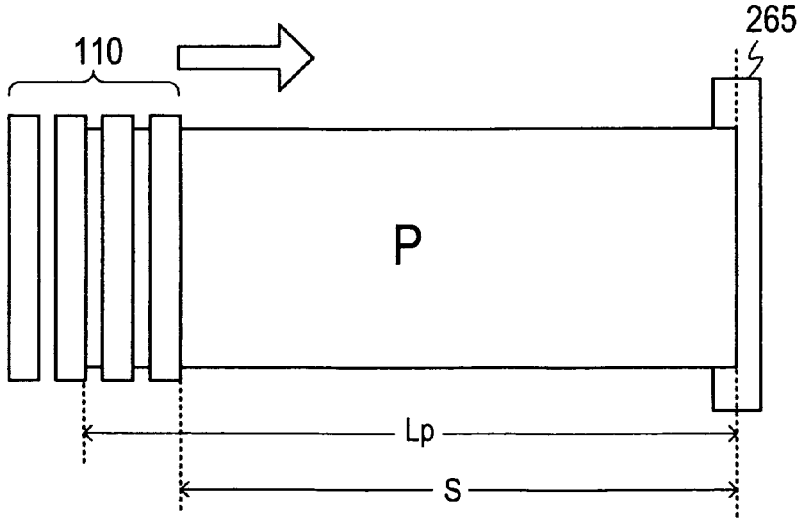

For use of a long sheet P with an equal or greater length Lp in transfer direction to or than the path distance S, as illustrated in FIG. 5C, the head unit 110 is still on the way of image formation when a leading edge of the sheet P has reached a position of paired top rollers 265. The top rollers 265 should be driven to transfer the sheet P at the same speed as a transfer speed Vg the transfer belt 160 then has.

Accordingly, this embodiment implements a sheet transfer control depending on a length Lp in transfer direction of sheet, as follows.

Figure 6A:
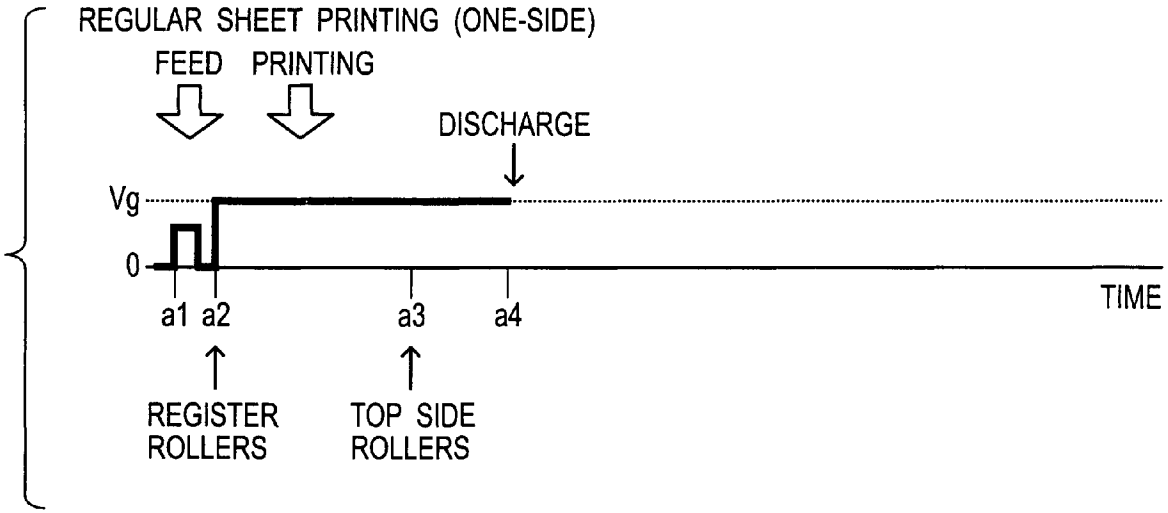
FIG. 6A is an explanatory time chart of sheet transfer control for one-side printing to a regular sheet in the printer 100, and FIG. 6B an explanatory time chart of sheet transfer control for both-side printing to a regular sheet.
Figure 6B:
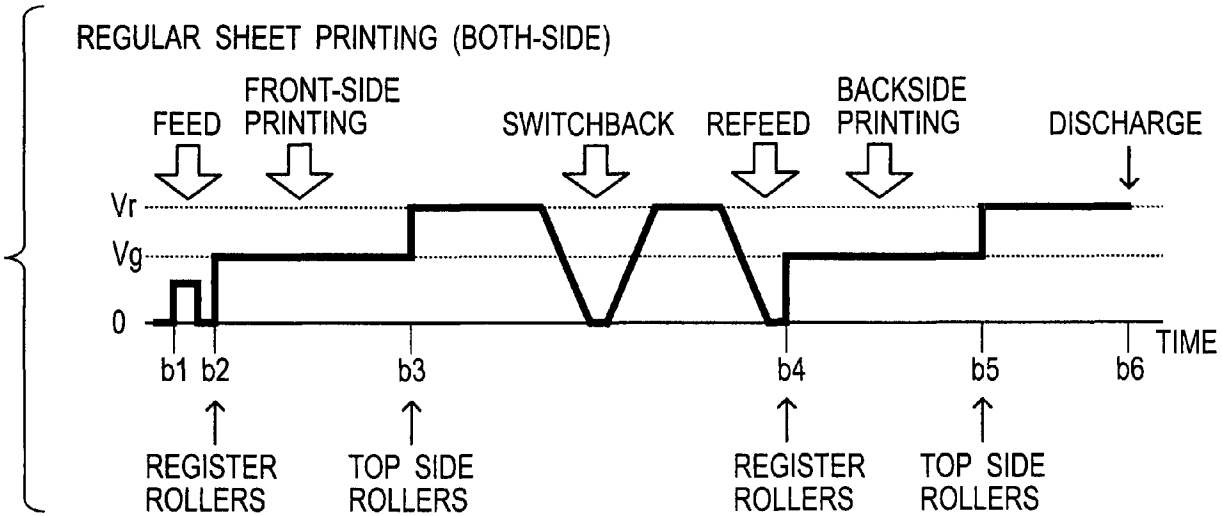

Description is now made of modes of transfer control for one-side printing and both-side printing of regular sheets in the printer 100, with reference to FIG. 6A and FIG. 6B. For the mode of one-side printing, each sheet as printed on the front side is discharged as it is straightly transferred, so the number of as-printed sheets that can be discharged per unit time is limited even with an increased transfer speed of top rollers 265. For the mode of both-side printing, a sheet as printed on the front side is routing the sheet circulating transfer route CR, while another sheet is fed and printed before the sheet as printed on the front side is re-fed, so the printing interval can be optimized by adjusting a transfer speed of top rollers 265, allowing for an increased number of output sheets per unit time.

FIG. 6A illustrates a varying sheet transfer speed in a one-side printing of a regular sheet Sheet feeding is now assumed to be from the side feed rack 120. As illustrated in the figure, at a time a1, the sheet is transferred by side feed rollers 220 at a prescribed transfer speed, and is fed to the register R, where it is put in a pause by register rollers 240. At a time a2, the sheet is transferred at a transfer speed Vg, while a printing is made thereon by the head unit 110. In due course, at a time a3, a leading edge of the sheet reaches a position of top rollers 265, while the sheet transfer speed is unchanged, so the transfer of sheet by the speed Vg is maintained, and at a time a4, the sheet is discharged. The printing is completed before the leading edge of sheet reaches the position of top rollers 265, and the sheet transfer speed of top rollers 265 can be increased, so the sheet can be transferred by the top rollers 265 at an increased speed suitable for discharge with a build momentum, for instance, while the number of output sheets per unit time remains unchanged.

FIG. 6B illustrates a varying sheet transfer speed in a both-side printing of a regular sheet. As illustrated in the figure, at a time b1, the sheet is transferred by side feed rollers 220 at a prescribed transfer speed, and is fed to the register R, where it is put in a pause by register rollers 240. At a time b2, the sheet is transferred at a transfer speed Vg, while a printing is made thereon by the head unit 110. In due course, at a time b3, a leading edge of the sheet reaches a position of top rollers 265, when the sheet transfer speed is changed to a speed Vr higher than the speed Vg. The printing is completed before the leading edge of sheet reaches the position of top rollers 265, and the sheet transfer speed of top rollers 265 can be increased, without effects on a result of printing. After a dropping switchback for inversion of sheet, the sheet is re-fed to the register R, where it is put in a pause by register rollers 240. At a time b4, the sheet is transferred at a transfer speed Vg for printing, where the head unit 110 makes a printing on the back side of the sheet. In due course, at a time b5, a leading edge of the sheet reaches the position of top rollers 265, when the sheet transfer speed is changed to a speed Vr higher than the speed Vg, and at a time b6, the sheet is discharged.

Figures 7A, 7B:
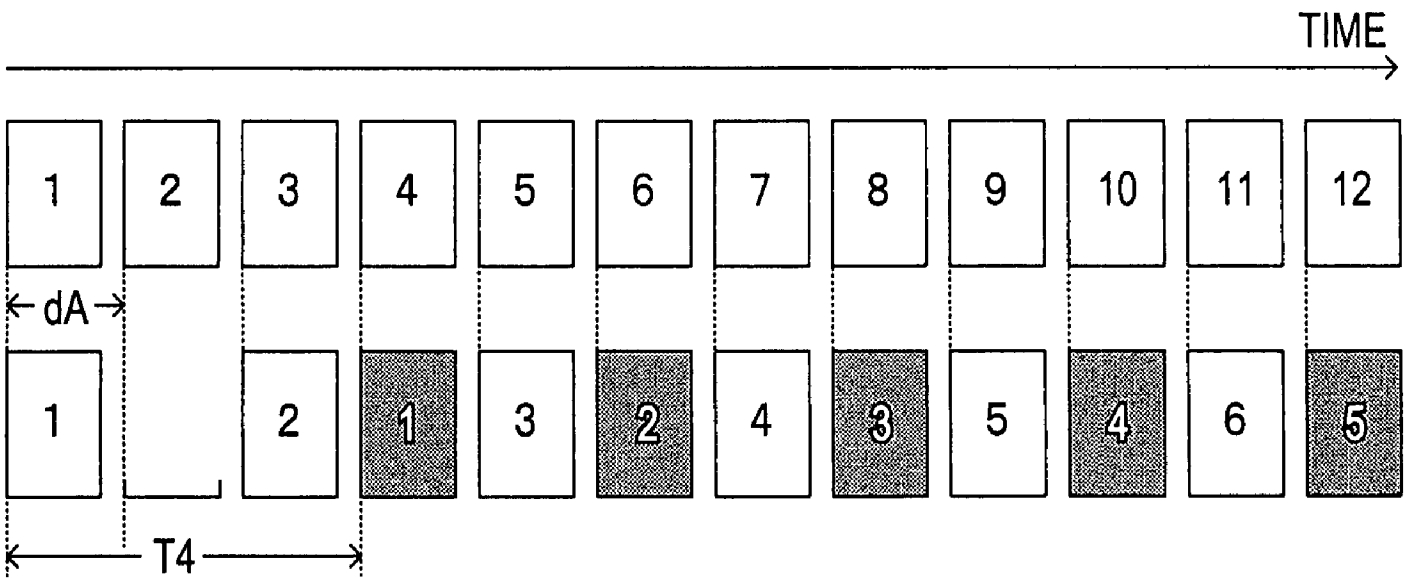
FIG. 7A and FIG. 7B are explanatory time charts of printing schedules for regular sheets in the printer 100, respectively.

The sheet transfer speed Vr is determined in a manner illustrated in FIG. 7A and FIG. 7B. In the figures, designated at integers are identification numbers of sheets, black integers on white background each representing a printing on the front side, white integers on black background each representing a printing on the back side. For one-side printing of sheets, as illustrated in FIG. 7A, a possible printing is assumed at intervals of time dA. For implementation of this printing speed in both-side printing, a printing to the back side of a first sheet is made at a timing for a printing to a fourth sheet in one-side printing. As a presumption for this example, N=3, the illustration is for a pattern of both-side printing that makes, between a printing on the front side of a sheet (e.g., a $2^{nd}$ sheet) and a printing on the back side of the sheet, a printing on the backside of a previous sheet (e.g., a $1^{st}$ sheet) and a printing on the front side of a subsequent sheet (e.g., a $3^{rd}$ sheet) fed anew. However, even if "N" takes another number, the sheet transfer speed Vr is determined in the same manner too.

Letting T4 be an interval of time from a start of printing on a first sheet to a start of printing on a fourth sheet in the one-side printing, the both-side printing is to enter a transfer for discharge of a first sheet with a lapse of time T4 from an initiation of printing to the first sheet. The sheet transfer speed Vr is determined in dependence on an associated set of printing conditions including information on a total path length of the sheet circulating transfer route CR, in considerations such as of a necessary time for switchback.

Figure 8A:
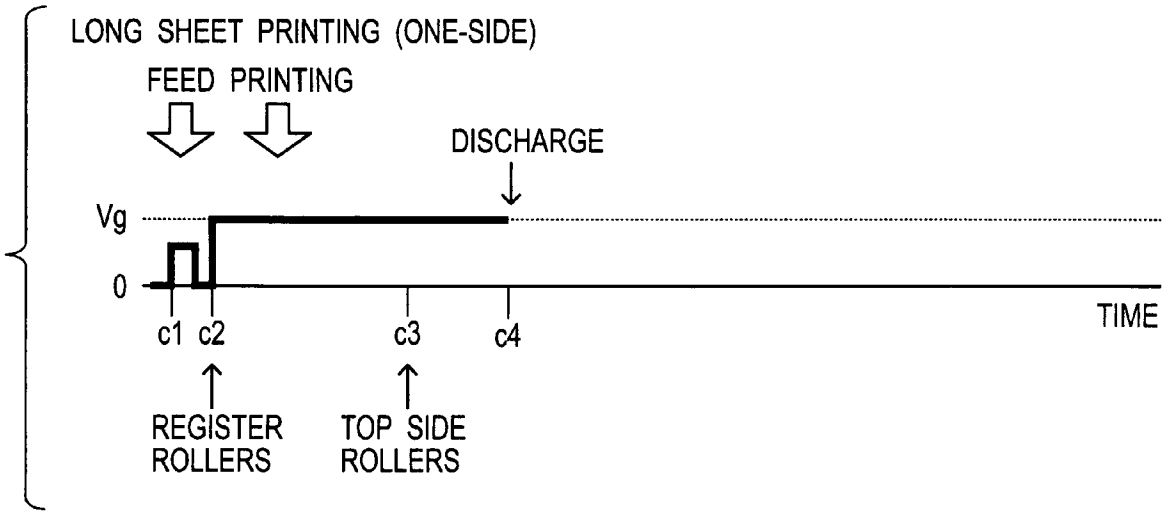
FIG. 8A is an explanatory time chart of sheet transfer control for one-side printing to a long sheet in the printer 100, and FIG. 8B an explanatory time chart of sheet transfer control for both-side printing to a long sheet.
Figure 8B:
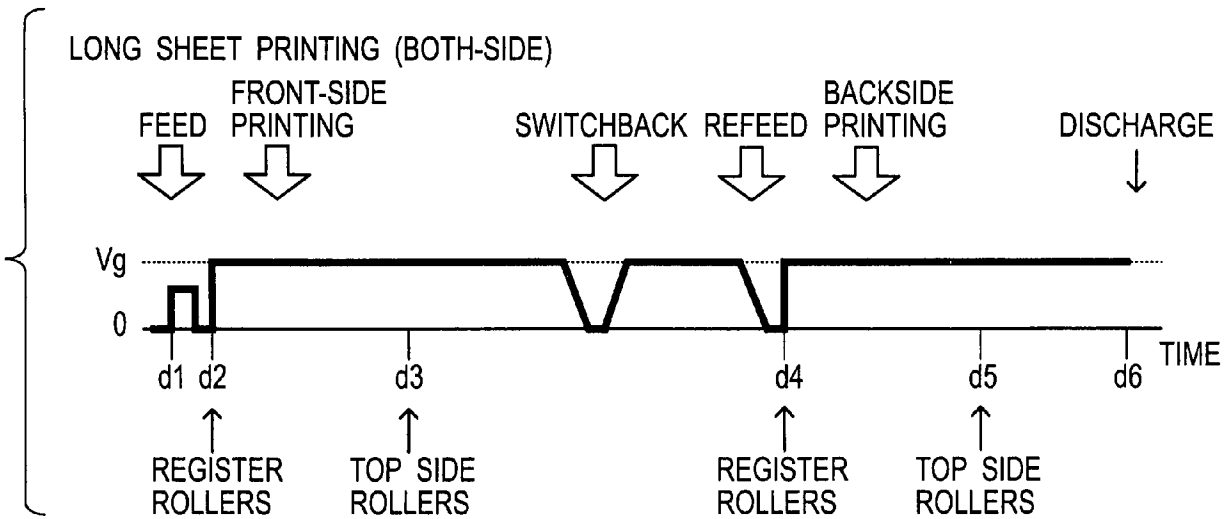

Description is now made of modes of transfer control for one-side printing and both-side printing of long sheets in the printer 100, with reference to FIG. 8A and FIG. 8B. FIG. 8A illustrates a varying sheet transfer speed in a one-side printing of a long sheet. As illustrated in the figure, at a time c1, the sheet is transferred by side feed rollers 220 at a prescribed transfer speed, and is fed to the register R, where it is put in a pause by register rollers 240. At a time c2, the sheet is transferred at a transfer speed Vg, while a printing is made thereon by the head unit 110. In due course, at a time c3, a leading edge of the sheet reaches a position of top rollers 265, while the sheet transfer speed is unchanged, so the transfer of sheet by the speed Vg is maintained, and at a time c4, the sheet is discharged. For the long sheet, when the leading edge of sheet has reached the position of top rollers 265, the printing is still on the way, and it is avoided to change the sheet transfer speed of top rollers 265. A resultant transfer control mode is identical to the one-side printing of regular sheet.

FIG. 8B illustrates a varying sheet transfer speed in a both-side printing of a long sheet. As illustrated in the figure, at a time d1, the sheet is transferred by side feed rollers 220 at a prescribed transfer and is fed to the register R where it is put in a pause by register rollers 240. At a time d2, the sheet is transferred at a transfer speed Vg, while a printing is made thereon by the head unit 110. In due course, at a time d3, a leading edge of the sheet reaches a position of top rollers 265, while the sheet transfer speed is unchanged, so the transfer of sheet by the speed Vg is maintained. For the long sheet, when the leading edge of sheet has reached the position of top rollers 265, the printing is still on the way, and it is avoided to change the sheet transfer speed of top rollers 265. After a dropping switchback for inversion of sheet, the sheet is re-fed to the register R, where it is put in a pause by register rollers 240. At a time d4, the sheet is transferred at a transfer speed Vg for printing, where the head unit 110 makes a printing on the back side of the sheet. In due course, at a time d5, a leading edge of the sheet reaches the position of top rollers 265, while the sheet transfer speed is unchanged, so the transfer of sheet by the speed Vg is maintained, and at a time d6, the sheet is discharged.

Figure 9A:
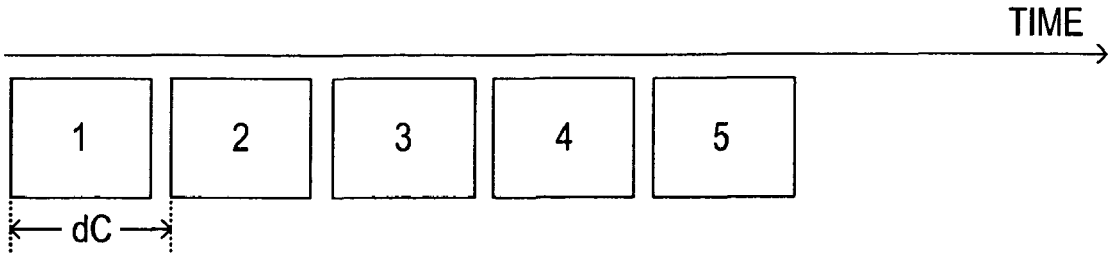
FIG. 9A and FIG. 9B are explanatory time charts of printing schedules for long sheets in the printer 100, respectively.
Figure 9B:
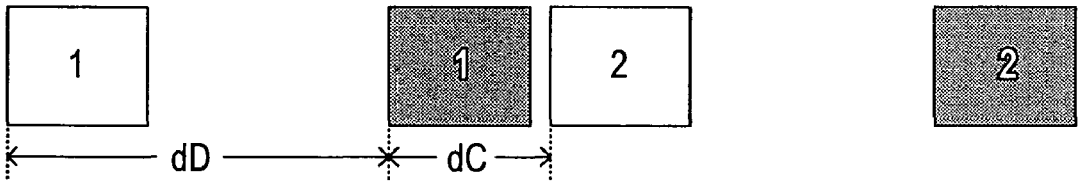

FIG. 9A and FIG. 9B illustrate resultant printing schedules for long sheets in the printer 100, respectively. For one-side printing of long sheets, as illustrated in FIG. 9A, a possible printing is assumed at intervals of time dC. In both-side printing of long sheets, as illustrated in FIG. 9B, after an initiation of a printing to the front side of a sheet, with a lapse of time dD till the sheet comes around at a sheet transfer speed Vg for the printing, there is a printing to the back side of the sheet, and with an additional lapse of time identical to the interval dC in the one-side printing, there is a printing to the front side of a subsequent sheet. That is, this embodiment implements a sheet transfer control to make a both-side printing of long sheets on a sheet basis. (N=1).

Figure 10:
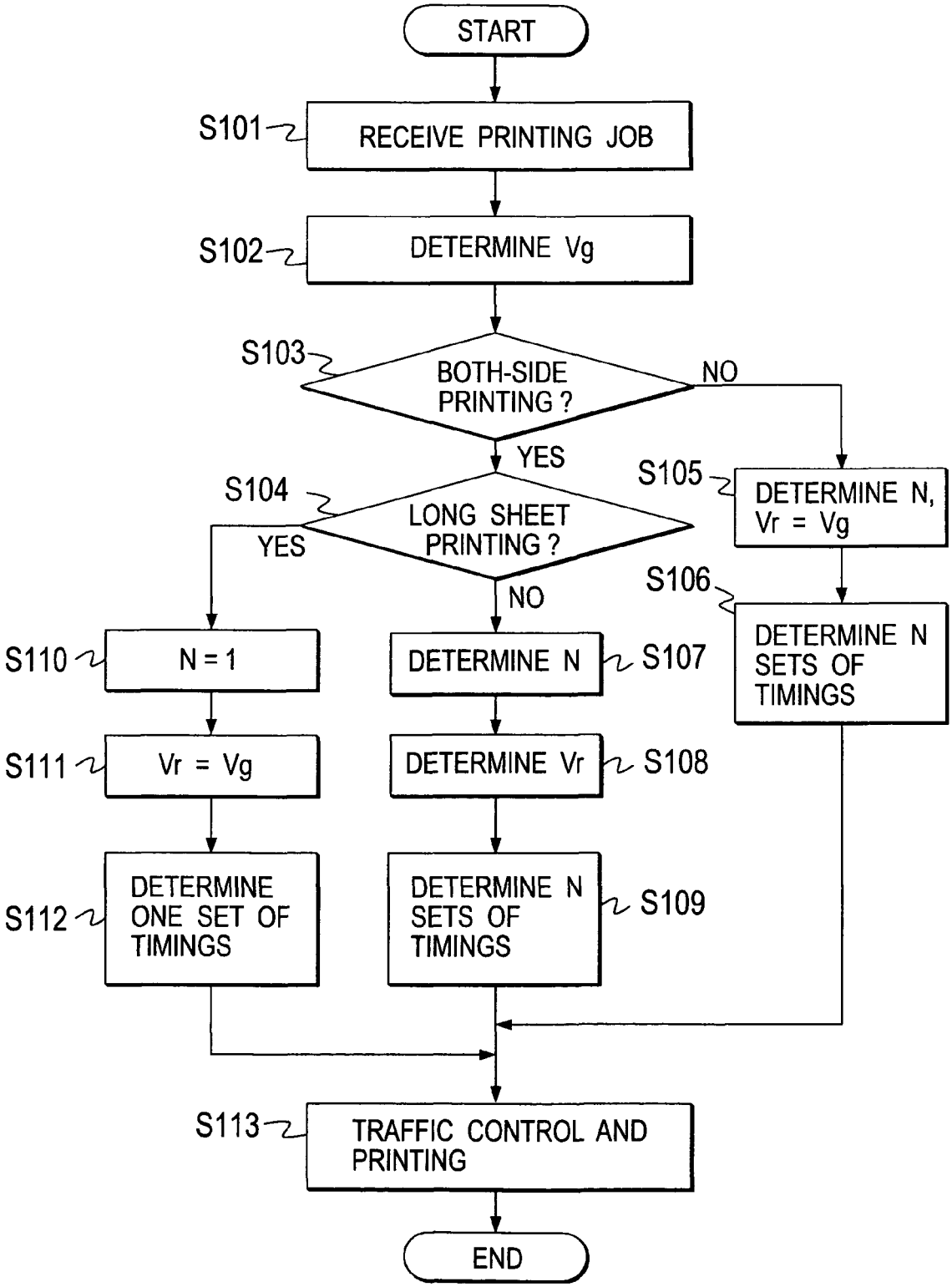
FIG. 10 is a flowchart of actions for sheet transfer control in the printer 100.

Description is now made of actions for sheet transfer control in the printer 100, with reference to a flowchart of FIG. 10. The sheet circulating transfer route CR has: a section directly associated with printing, with the transfer belt 160 and top rollers 265 inclusive; and the rest, which is referred herein sometimes to a speed variable section. At a step S101, the controller 300 receives a printing job from the operation panel 400 or a PC connected to the printer 100, when the sheet transfer control starts.

At a step S102, given printing conditions in the printing job are referenced to set up a sheet transfer speed Vg for printing. The sheet transfer speed Vg for printing is a speed to be consistent with an ink-droplets propelling for image formation of the head unit 110, and depends on a maximal ink droplet number per pixel, resolution, and the like to be defined by information in given printing conditions. Given such printing conditions, for the sheet transfer speed Vg for printing, a maximum value is uniquely determined in accordance with performances of an ink propelling mechanism of the printing mechanism, in particular of the head unit 110, ink properties, and the like, irrespective of whether one-side printing or both-side printing, whether regular sheet or long sheet. This embodiment assumes a sheet transfer at a maximum speed the printing mechanism is afforded to provide for a sufficient exhibition of its performance, and a commensurate sheet transfer speed is set as the sheet transfer speed Vg for printing, as it is an operational maximal speed in consideration of prescribed margins and the like, that is not always in accord with a physical maximum speed.

At a step S103, on the basis of given printing conditions, the printing condition determiner 320 determines whether or not the printing job is both-side printing. As a result of this determination, unless the printing job is both-side printing (that is, if it is one-side printing), the control flow goes to a step S105, where a sheet transfer speed Vr for the speed variable section is set up as identical to the sheet transfer speed Vg for printing, and an associated N is set. In the speed variable section, the sheet transfer speed will be unchanged. Then, at a step S106, for feed rollers 220 and register rollers 240, N sets of start timings are set, and at a step S113, courses of printing are executed at set timings.

Figure 11A:
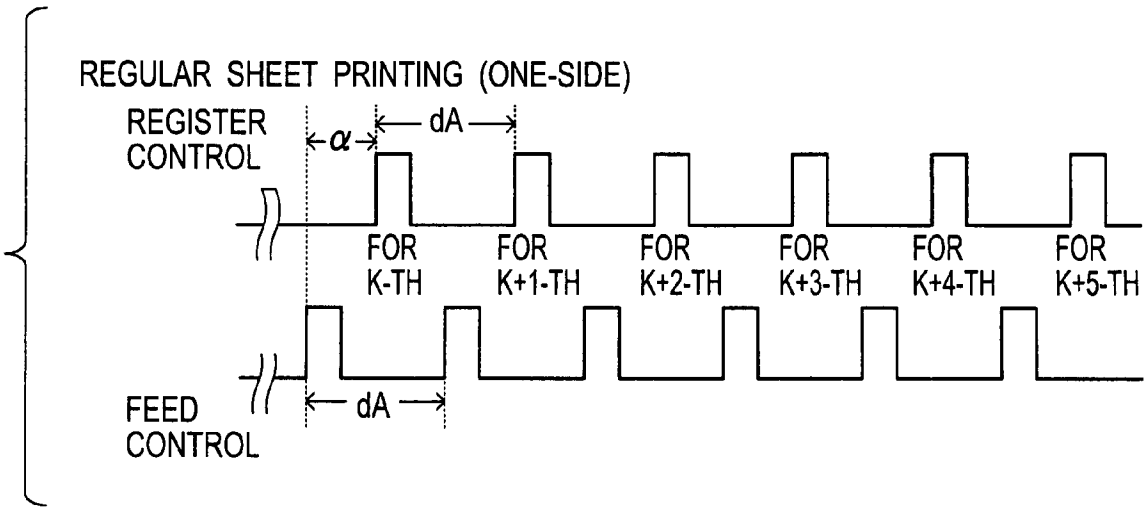
FIG. 11A is a time chart of control pulses for starting register rollers 240 and feed rollers 220 in one-side printing to regular sheets in the printer 100, and FIG. 11B a time chart of control pulses for starting register rollers 240 and feed rollers 220 in both-side printing to regular sheets.

FIG. 11A is a time chart of control pulses for starting feed rollers 220 and register rollers 240 in a one-side printing of regular sheets. This figure corresponds to FIG. 6A and FIG. 7A. As illustrated in the figure, register rollers 240 start a transfer of sheet on a sheet-side basis at an interval of time dA. Feed rollers 220 start a feed of sheet at an anterior $\alpha$ to a start timing of the register rollers 240, for guiding the sheet to the register rollers 240. For the printing job of one-side printing, the sheet feed by feed rollers 220 is made at an interval of time dA every time for the register rollers 240 to start.

Figure 12A:
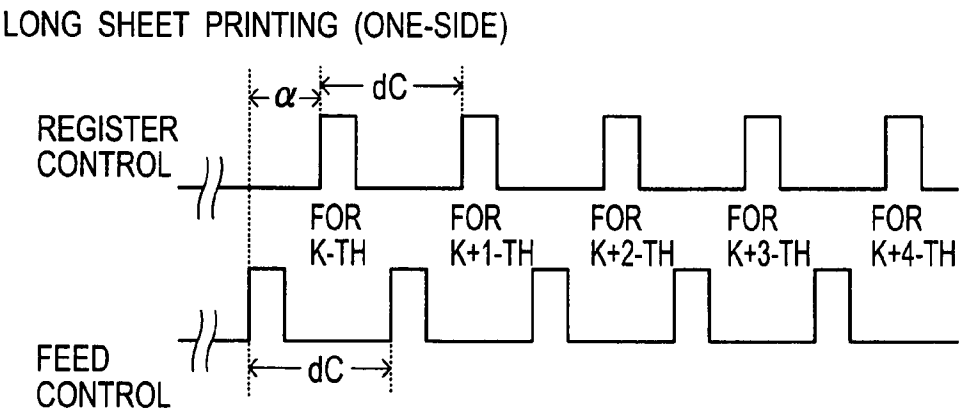
FIG. 12A is a time chart of control pulses for starting register rollers 240 and feed rollers 220 in one-side printing to long sheets in the printer 100, and FIG. 12B a time chart of control pulses for starting register rollers 240 and feed rollers 220 in both-side printing to long sheets.

FIG. 12A is a time chart of control pulses for starting feed rollers 220 and register rollers 240 in a one-side printing to long sheets. This figure corresponds to FIG. 8A and FIG. 9A. As illustrated in the figure, register rollers 240 start a transfer of sheet on a sheet-side basis at an interval of time dC. Feed rollers 220 start a feed of sheet at an anterior $\alpha$ to a start timing of the register rollers 240, for guiding the sheet to the register rollers 240. For the printing job of one-side printing, the sheet feed by feed rollers 220 is made at an interval of time dC every time for the register rollers 240 to start.

As a result of determination at the step S103, if the printing job is both-side printing ('Yes'), the control flow goes to a step S104, where the printing condition determiner 320 determines whether the printing job is a printing of long sheet (i.e., whether the length in transfer direction of sheet is equal in length to or longer than the path distance from the head unit 110 to a position of top rollers 265). As a result of this determination, if the printing job is a printing of long sheet ('Yes' at the step S104), the control flow goes to a step S110 for setting n=1, and to a step S111, where a sheet transfer speed Vr for the speed variable section is set up as identical to the sheet transfer speed Vg for printing. In the speed variable section, the sheet transfer speed will be unchanged. Then, at a step S112, for feed rollers 220 and register rollers 240, their start timings are set, and at the step S113, courses of printing are executed at set timings.

On the other hand, as a result of determination at the step S104, unless the printing job is a printing of long sheet ('No', that is a printing of regular sheet), the control flow goes to a step S107, where N is determined in accordance with a sheet size and a path length of the sheet circulating transfer route CR. More specifically, N is determined in accordance with the number of sheets that can be simultaneously transferred along the sheet circulating transfer route CR, subject to an odd number as N in this case to permit a required alternate printing of front side and back side of different sheets.

Then, at a step S108, sheet transfer speeds Vr for the speed variable section are determined by calculation to implement a both-side printing of N regular sheets with an even productivity of printing material to one-side printing, as illustrated in FIG. 6B and FIG. 7B. Then, at a step S109, for feed rollers 220 and register rollers 240, N sets of start timings are set, and at the step S113, courses of printing are executed at set timings.

Figure 11B:
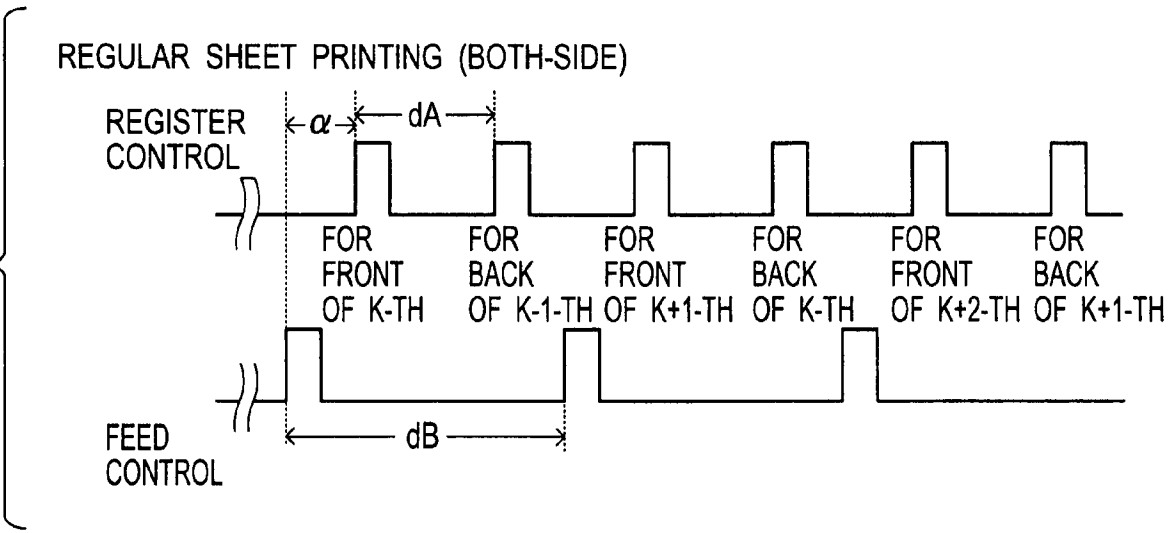

FIG. 11B is a time chart of control pulses for starting register rollers 240 and feed rollers 220 in a both-side printing to regular sheets. This figure corresponds to FIG. 6B and FIG. 7B. As illustrated in the figure, register rollers 240 start a transfer of sheet at an interval of time dA in accordance with a schedule for both-side printing. The illustration is for a pattern of both-side printing for N=3 that makes, between a printing on the front side of a sheet (e.g., K-th sheet) and a printing on the back side of the sheet, a printing on the backside of a previous sheet (e.g., K−1-th sheet) and a printing on the front side of a subsequent sheet (e.g., K+1-th sheet) fed anew.

For the printing job of both-side printing, feed rollers 220 start a feed of sheet at an anterior $\alpha$ to a start timing for front-side printing of register rollers 240, for guiding the sheet to the register rollers 240. The sheet feed by feed rollers 220 is made at an interval of time dB every time for the register rollers 240 to start for front-side printing, such that dB=dA×2.

Figure 12B:
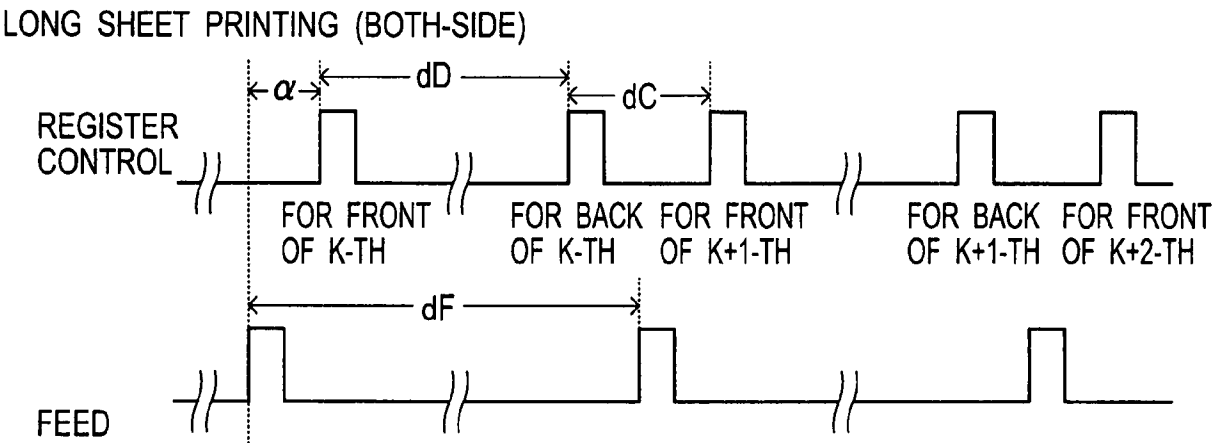

FIG. 12B is a time chart of control pulses for starting register rollers 240 and feed rollers 220 in a both-side printing to long sheets. This figure corresponds to FIG. 8B and FIG. 9B. As illustrated in the figure, register rollers 240 start transfer of a sheet for front-side printing, and thereafter, transfer of the sheet for back-side printing at an interval of time dD. After that, they start transfer of a subsequent sheet for front-side printing at an interval of time dC.

For the both-side printing, feed rollers 220 start a feed of sheet at an anterior $\alpha$ to a start timing for front-side printing of register rollers 240, for guiding the sheet to the register rollers 240. The sheet feed by feed rollers 220 is made at an interval of time dF every time for the register rollers 240 to start for front-side printing, such that dF=dD+dC.

As will be seen from the foregoing description, according to the present embodiment, a length in transfer direction of sheet is taken into consideration to control a sheet transfer speed for printing and a sheet transfer speed for circulation. More specifically, upon a determination that the length in transfer direction of sheet is shorter than a path distance S, where the printing is completed before a leading edge of sheet reaches a position at the path distance S, the sheet transfer speed for circulation is set up as higher than the sheet transfer speed for printing, thereby allowing for an enhanced productivity. Upon a determination that the length in transfer direction of sheet is equal to or longer than the path distance S, where the printing is still on the way when the leading edge of sheet has reached the position at the path distance S, the sheet transfer speed for circulation is set up as identical to the sheet transfer speed for printing, thereby allowing for a prevented deterioration of printing quality due to a deviation.

For both-side printing, upon the determination that the length in transfer direction of sheet is shorter than the path distance S, an alternate printing is implemented between front side and back side of different sheets, allowing for an enhanced productivity, and upon the determination that the length in transfer direction of sheet is equal to or longer than the path distance S, an associated printing is implemented on a sheet-side basis, allowing for an enhanced integrity of the process.

While preferred embodiments of the present invention have been described using specific terms, such description is for illustrative purposes, and it is to be understood that changes and variations may be made without departing from the spirit or scope of the following claims.

This application is based upon the Japanese Patent Application No. 2008-184170, filed on Jul. 15, 2008, the entire content of which is incorporated herein by reference.

What is claimed is:

1. A printer comprising:

a printing mechanism comprising:

a sheet transfer portion configured with a first drive member for transfer of a sheet as positioned thereto; and an image former configured to form an image on the sheet as positioned to provide a sheet as image-formed;

a sheet circulating transfer route including:

the sheet transfer portion of the printing mechanism;

a transfer section having a second drive member for transfer of the sheet as image-formed configured in a position at a prescribed path distance from the image former of the printing mechanism; and a sheet invert portion configured to invert the sheet as image-formed;

a printing condition determiner configured to determine a set of printing conditions including a first condition that a sheet to be positioned in the printing mechanism is equal in length to or longer than the prescribed path distance and a long sheet to be printed on both sides thereof; and a drive controller configured to control the first drive member to establish a first transfer speed of the sheet as positioned and the second drive member to establish a second transfer speed of the sheet as image-formed in accordance with the set of printing conditions determined by the printing condition determiner, the drive controller being adapted, in conformity to the first condition, to set the second transfer speed as identical to the first transfer speed, and in non-conformity to the first condition, to set the second transfer speed as greeter than the first transfer speed.

2. The printer as claimed in claim 1, wherein the set of printing conditions includes a second condition that the sheet to be positioned is a sheet to be printed on one side thereof, whether a regular sheet or an irregular sheet, and the drive controller is adapted, in conformity to the second condition, to set the second transfer speed as identical to the first transfer speed.

3. The printer as claimed in claim 1, further comprising a frame processor configured to generate a sequence of frames of image data on a sheet-side basis according to an associated printing job, to output to the image former, wherein the set of printing conditions includes a collateral condition that the sheet to be positioned is a sheet to be printed on both sides thereof, and the frame processor is adapted, in conformity to the first condition, to generate in order a sequence of flames of image data for a front side of an associated first sheet, and a sequence of frames of image data for a back side of the first sheet, and in non-conformity to the first condition with the collateral condition, before generating a sequence of frames of image data for a back side of an associated second sheet, to generate a sequence of frames of image data for a front side of a subsequent sheet of the second sheet.

* * * * *